US005366249A

United States Patent [19]

Diemert

[11] Patent Number: 5,366,249

[45] Date of Patent: Nov. 22, 1994

[54] STRIP BAGGAGE TAG

[75] Inventor: Kurt Diemert, Gleisweiler, Germany

[73] Assignee: Fix GmbH, Germany

[21] Appl. No.: 961,441

[22] Filed: Oct. 15, 1992

[30] Foreign Application Priority Data

Oct. 16, 1991 [DE] Germany ..... 4134231

[51] Int. Cl.[5] ..... B42D 15/00

[52] U.S. Cl. ..... 283/80; 428/42; 40/299

[58] Field of Search ..... 281/5; 156/250; 283/80, 283/81, 101; 428/40–43; 40/299, 625, 630

[56] References Cited

U.S. PATENT DOCUMENTS 3,228,129 1/1966 Gwinn et al. ..... 283/80 X
3,994,085 11/1976 Groselak et al. ..... 283/80 X
4,666,185 5/1987 Pilborough ..... 283/80
4,882,861 11/1989 Holmes et al. ..... 283/80 X

FOREIGN PATENT DOCUMENTS 8911858 12/1989 Germany .
9110080 11/1991 Germany .

*Primary Examiner*—Willmon Fridie

*Attorney, Agent, or Firm*—Ostrolenk, Faber, Gerb & Soffen

[57] ABSTRACT

A strip baggage tag (1) includes a tag part (3) which can be written on and attached to an article of baggage, arid a control sect ion (4). The control section (4) includes a tear-off part (5) which can be detached from the tag part (3) along a transversely extending separation line (6). The tag part (3) and the tear-off part (5) have respective back adhesive areas (11',11'') coated with a pressure-sensitive adhesive on both sides of the separation line (6). The adhesive areas (11',11'') are covered by a one-piece lower web section (14) which forms part of the control section (4) and is developed for carbonless copying on its top facing the tag part (3). The lower web section (14) is continuously separation-active (17) except for a partial region (18) below part of the adhesive area (11'') on the tear-off part (5) of the control section (4). This partial region (18), which is made separation-inactive for instance by corona treatment, forms an attachment bridge so as to form a firm connection between the lower web section (14) and the tear-off part (5), so that they together form the control section (4) for being adhered to an airplane ticket for identification of an article of baggage, after subsequent exposure of part of the adhesive area (11'').

7 Claims, 3 Drawing Sheets

FIG. 6
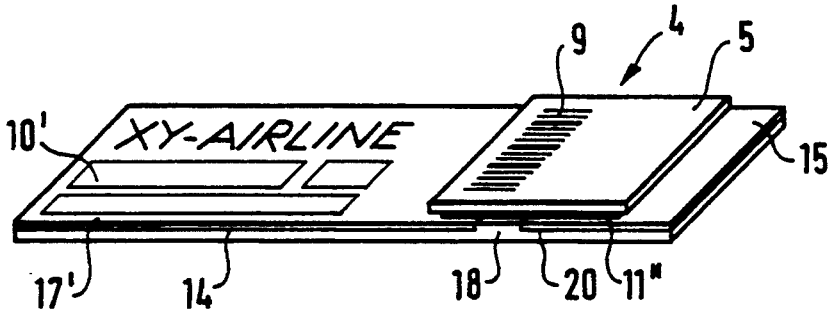
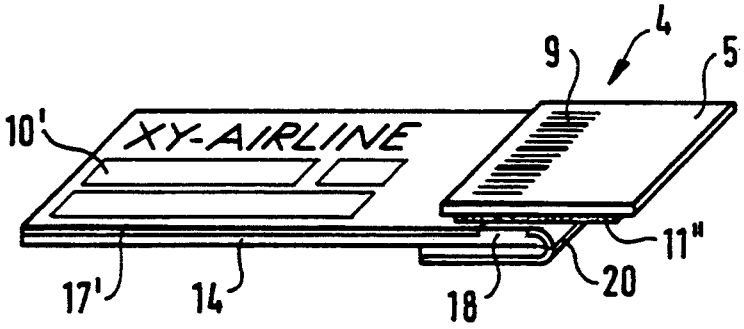
FIG. 7

STRIP BAGGAGE TAG

CROSS-REFERENCE TO RELATED APPLICATION

This application is related to the commonly assigned application filed on even date herewith in the name of Kurt Diemer, titled STRIP BAGGAGE TAG IN ENDLESS OR ROLL FORM FOR MACHINE PRINTING (Attorney Docket FA-1427 (1624-7)), the disclosures of which are incorporated by reference herein.

BACKGROUND OF THE INVENTION

1. Field of the Invention

The present invention relates to a strip baggage tag having a tag part which can be written upon and attached to a bag, and a carbonless-copying control section. It also relates to a method for the production of such a tag.

2. Background Art

In order to identify baggage, particularly in international air travel, baggage tags are used which consist essentially of two parts, namely a tag part which can be attached to an individual bag, and a control section which makes it possible to identify the bag and includes a claim check which is turned over to the person checking the baggage.

When a passenger checks in at the counter of an airline, the destination airport, flight number, etc. are written on the baggage tag; the tag part is then attached to the bag in question and the control section is generally stapled to the ticket. When there are certain words which are to appear on both the tag part and the control section, the writing is done by a copying process, for which purpose a suitably prepared carbonless-copying coating is provided.

Thus, in the case of one known baggage tag of this type, a strip of material is folded at its center to form a two-layer tag part and is provided in the vicinity of the fold with a hole through which a wire or string can be inserted for attaching it to a bag; the carbonless-copying control section is formed at the two layers of the tag part (DE-U 89 11 858). The control section bears at one end an adhesive strip which is covered by silicone paper. Another adhesive strip, also covered by silicone paper, is present on the outer end of the lower layer of the tag part, which serves as a tear-off part and can be detached in addition along a line of perforations.

This baggage tag can be manufactured only at great expense. It requires multiple backings and requires applying layers of adhesive and silicone on different parts and bringing them together. It requires a corresponding expense when the parts are separated from each other after they have been written on, and after they are attached to the bag and to the ticket of the passenger.

In order to avoid the necessity of disposing of silicone-coated parts as waste, in another known baggage tag, the control section is developed as a tear-off part which can be torn off along a line of perforations, and adhesive layers are arranged below both the tear-off part and the tag part and are covered by a silicone-coated cover strip (DE-U 91 10 080). In this case, the silicone coatings leave uncoated transversely extending marginal strips on the cover strips, so that after the control section is detached from the tag part, the silicone-coated parts of the cover strip which remain on the tear-off part as well as on the tag part remain attached to them. In order to expose the adhesive layers, these parts are folded around the edges between the silicone-coated and the uncoated surfaces. It is not possible to provide for writing on the control section.

The disclosures of all prior art materials mentioned herein are expressly incorporated by reference.

It is becoming more and more usual for airlines to provide baggage tags with a bar code in order to have a marking which is proof against falsification and can be read by scanners, and in order to be able to reliably identify and register bags and transport them along their route. Furthermore, it should be possible, not only when initially checking in but also when changing planes or other means of conveyance, to detach additional parts of the baggage tag so as to be able to further continue to follow the routing of the bag in question. These additional parts must, of course, also be provided with a bar code.

Due to the large amount of information to be provided by a bar code, this code must be printed in overlapping fashion, i.e., the lines and spaces must be of different widths in order to be able to impart different meanings to them. Such a bar code can only be applied by contact-less printers, namely so-called "non-impact" printers. Such printers have a very narrow passage slot; furthermore, they produce a very large amount of heat. These printers therefore cannot be used for the subsequent printing of multilayer parts which are coated with pressure-sensitive adhesive since, on the one hand, these parts are of different thicknesses, and on the other hand, the adhesive coating might be melted.

SUMMARY OF THE INVENTION

Based on the consideration that, in the case of a baggage tag, both the method of manufacture and the handling by the user must be considered as aspects of a complex system, in combination with the product itself, important objects of the invention are to develop a strip baggage tag of the aforementioned type such that there are no parts coated with a separating agent which must, dispose of, such that both the production and the individual use of the tag are simplified; such that the application of overlapping bar codes to the tag part, the control section and possibly additional parts is made easier; and finally, such that the handling of the baggage tag at the counter is simplified.

These objects may be achieved by products and processes in accordance with embodiments of the invention by the features set forth and claimed herein.

According to an aspect of the invention, a strip baggage tag may have a control section, and a tag part which is adapted for being written on, on a front side thereof, and applied to an article of luggage. The control section preferably comprises a tear-off part which can be detached from the tag part along a transversely extending separation line, while adhesive areas may be arranged on a back side of the tag part and the tear-off part on both sides of the separation line. The control section further comprises a single-piece lower web section which covers the adhesive areas and has means on its top side for copying of impressions made on the tag part. The lower web section preferably is substantially continuously separation-active except for a partial region below the adhesive area of the tear-off part for adhering the lower web section to the tear-off part.

An important advantage of the invention is that the carbonless-copying part of the control section is adapted so that it can also serve as a separating means. Thus it serves both as a data support for the data entered at the counter, and also as a protective coating for the adhesive areas.

Another advantage is that the partial region without separation means which is located below the adhesive area of the tear-off part acts as an attachment bridge, so that the carbonless-copying part is firmly attached to the tear-off part. After detachment of the tear-off part from the tag part along the separation line, the tear-off part and tag part together form the control section which can then be attached to a ticket by exposing the adhesive area.

One method for the production of a baggage tag in accordance with an embodiment of the invention is also set forth and claimed herein. This aspect of the invention relates to a continuous process for producing a strip baggage tag having a carbonless-copying control section, and a tag part which is adapted for being written on, on a front side thereof, and applied to an article of luggage; in which both the tag part and the control section have a respective adhesive area coated with a pressure-sensitive adhesive; the control section comprising a tear-off part which can be detached from the tag part along a transversely extending separation line; the adhesive areas being arranged on the back of the tag part and of the tear-off part on both sides of the separation line; the adhesive areas being covered by a single-piece lower web section which has means for carbonless copying on its top side of impressions made on said tag part, and is substantially continuously separation-active except for a partial region below the adhesive area of the tear-off part for adhering the lower web section to the tear-off part. The process comprises the steps of removing a web of material, the width of which corresponds to the length of the strip baggage tag to be produced, from a roll; providing the web on its front side with a bar code; applying an adhesive for forming the adhesive areas; continuously feeding in the lower web section which is coated separation-actively except for the partial region, and is developed for carbonless copying on its front side, and combining the lower web section with the web of material; and then cutting the web in transverse direction into strips.

Thus, the manufacturing process only requires a web of material which may consist of ordinary commercial or laminated and correspondingly tear-resistant material, and which can be printed in a continuous process including an application of adhesive. In this connection, all the printing lies on the same side of the web; and subsequent or additional further treatments, in particular expensive mutual multiple laminations or folding steps, are unnecessary. It is merely necessary to subsequently feed in the lower web, which provides a protective covering and is also developed for carbonless copying, which will adjoin the region of the web having the adhesive areas, and to combine it with the web of material, with which it can then be cut.

The separation-active development of webs for the protection of coatings of pressure-sensitive adhesive is customarily obtained by a silicone coating which forms a continuous surface on which an adhesive cannot anchor itself. For reasons of environmental protection, a silicone coating is today applied in aqueous solution, which means that manufacturing requires very long drying paths. Interruptions in the silicone coating are thus difficult to produce, and it is also difficult, when placing the webs together, to precisely associate continuous regions of the silicone-coated web with the corresponding regions of the web of material, namely the adhesive areas.

Viewed against this background, a feature of the invention of particular importance is that the protective web is first of all coated continuously in separation-active manner (e.g., with a separating agent), and then partial regions of the protective web are subjected to a so-called corona treatment in order to eliminate the separation activity in these regions.

In such a corona treatment, which is known per se in the converting and printing industry, the web to be treated is passed between two electrodes, one of which is developed as a support roll. In the discharge slot formed between these two electrodes, high voltage is applied via a fine corona discharge both very uniformly and gently to the surface of the web. By such a treatment, which can be incorporated in the manufacturing process of the baggage tags, even at stages involving high speeds of passage, it is possible to treat stripwise regions of a continuously separation-active coated web so that the separation activity is eliminated at least until the webs are brought together.

The invention also easily satisfies the requirement that identical bar codes must be provided on the two ends of the tag part and on the control section; and further, that additional sections printed with the bar code must also be available for being detached subsequently, after a change of plane or other mode of transportation.

Other features and advantages of the present invention will become apparent from the following description of the invention which refers to the accompanying drawings.

BRIEF DESCRIPTION OF THE DRAWINGS

One embodiment of the invention will be explained in further detail below, with reference to the drawings, in which:

FIG. 6 shows the control section after detachment from the tag part;

FIG. 7 shows the control section after the grip tab coated with separation agent is folded over and the adhesive area exposed;

DETAILED DESCRIPTION

Figures 1, 2, 3, 4, 5:
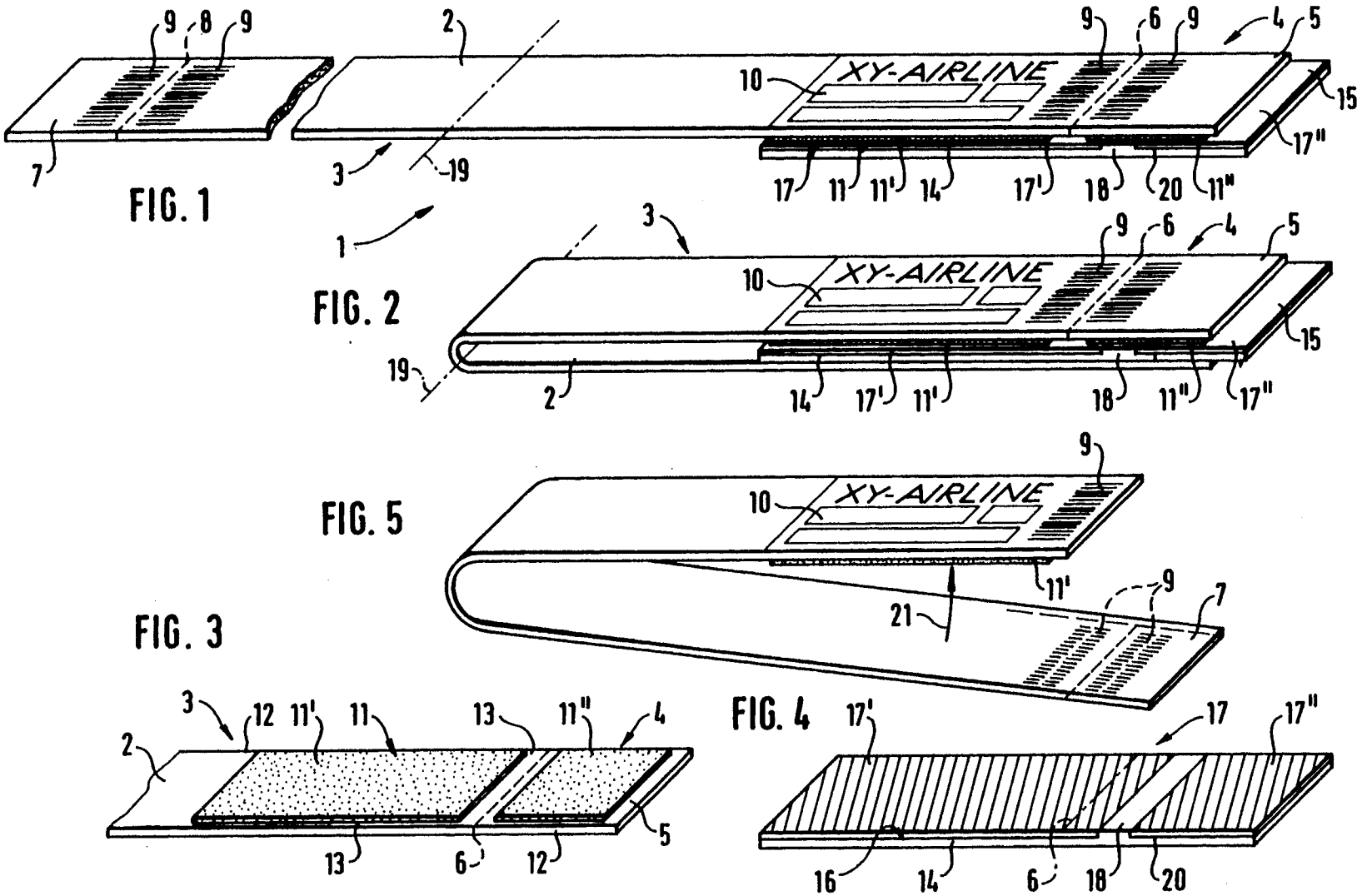
FIG. 1 is a perspective view of a strip baggage tag in accordance with an embodiment of the invention.
FIG. 2 shows a strip baggage tag according to FIG. 1, shown folded.
FIG. 3 is a view of the bottom of the upper web showing the adhesive areas.
FIG. 4 is a top view of the lower web section showing the separation-active coating.
FIG. 5 shows the tag part after detachment of the control strip with the adhesive layer exposed, for forming a loop around the handle of an article of baggage.

One embodiment of a strip baggage tag in accordance with the invention is shown, in perspective views, in extended form in FIG. 1 and in folded form in FIG. 2.

The strip baggage tag 1 has a continuous upper web 2 of tear-resistant material such as paper, and possibly also a foil. The tag 1 comprises a tag part 3 and a control section 4, also known as a baggage claim section. The control section 4 comprises, first of all, a tear-off part 5 which is formed in the upper web 2 and can be detached from the tag part 3 along a transversely extending separation line 6, for instance a separation cut or a separation perforation.

In the embodiment shown, there is provided on the opposite end of the tag part 3 an additional section 7 which, in its turn, can be detached along a separation line 8 from the tag part 3. The additional section 7 can be adjacent to further additional sections. Such an additional section 7 could also be arranged at the other end of the tag part 3, that is, between the tag part 3 and the tear-off part 5.

For the identification of a piece of baggage, the tag part 3 is provided on its two ends with identical bar codes 9, in each case adjacent to the separation lines 6 and 8 respectively, and the tear-off part 5 on the control section 4, as well as the additional section 7 and any further additional sections, are also provided in each case on the front side with the same identical bar codes 9, which may be adjacent to the separation lines as shown in FIG. 1. On one end of the tag part 3, adjacent to the control section 4, there is a preprinted label box 10 within which the tag part 3 can be written on by hand or by automatic printers.

As shown in FIG. 3, pressure-sensitive adhesive 11 is applied to regions on the back of the upper web 2, forming a long adhesive area 11' below the tag part 3 and a short adhesive area 11'' below the tear-off part 5. The adhesive areas 11' and 11'' do not extend up to the longitudinal edges 12 of the upper web 2; rather, narrow marginal areas 13 are left free of adhesive adjacent the longitudinal edges 12.

Below the adhesive areas 11' and 11'' there is a lower web section 14 which has the same width as the upper web 2 and protrudes beyond the tear-off part 5 as shown at the right-hand end of FIG. 1, where it forms a grip tab 15. As can be noted in particular from FIG. 4, which is an oblique top view of this lower web section 14, its top side 16 facing the adhesive areas 11', 11'' is developed for carbonless copying and is coated with a separating agent 17, for instance silicone. It is readily possible to apply a separating agent, for instance silicone, onto a surface developed for carbonless copying, without impairing the properties thereof.

The coating 17 forms two separation-active regions, a long region 17' to the left in FIG. 4, extending approximately to below and beyond the separation line 6 in the upper web 2, and a short right-hand region 17'' below the tear-off part 5. A region 18 which is not separation-active is present between the two regions 17' and 17''. This region 18 can be formed either by applying no separating agent, or else by making an originally continuous application of separating agent inactive in this region.

From the point of view of the user, such a tag 1 can be written on either by hand or else by machine. In this connection, as a result of the carbonless-copy coating, the writing entered in the box 10 is also transferred to the lower web section 14, which bears an identically developed writing box 10' (FIG. 6). The lower web section 14 is then detached manually from the adhesive area 11' together with the tear-off part 5, from the tag part 3, along the separation line 6. The region 18 of the lower web section 14 which is free of separating agent and is located below the tear-off part 5 forms an attachment bridge by which the lower web section 14 is firmly bonded to the tear-off part 5 in this region.

Thus, the lower web section 14, which is coated with separating agent, does not constitute waste and need not be disposed of. Moreover, as shown in FIGS. 6 and 7, the lower web section 14 is an integral part of the control section 4. Further, by folding the grip tab 15 by 180° around a bend perforation 20 in order to expose a part of the adhesive area 11'', the lower web section 14 can be attached by adhesion to an airplane ticket for identification of the article of baggage in question.

After removal of the control section 4, the tag part 3 is placed, in the manner shown in FIG. 5, as a loop around the handle of a bag, and its ends bonded together in the direction indicated by the arrow 21. A bar code 9 is present on the top side of the loop and an identical bar code 9 is present on the bottom side thereof. The protruding additional section 7 and any other additional sections adjoining it can, in the event of a subsequent transfer between aircraft or change in the means of transportation, be detached along the separation line 8.

Figure 8:
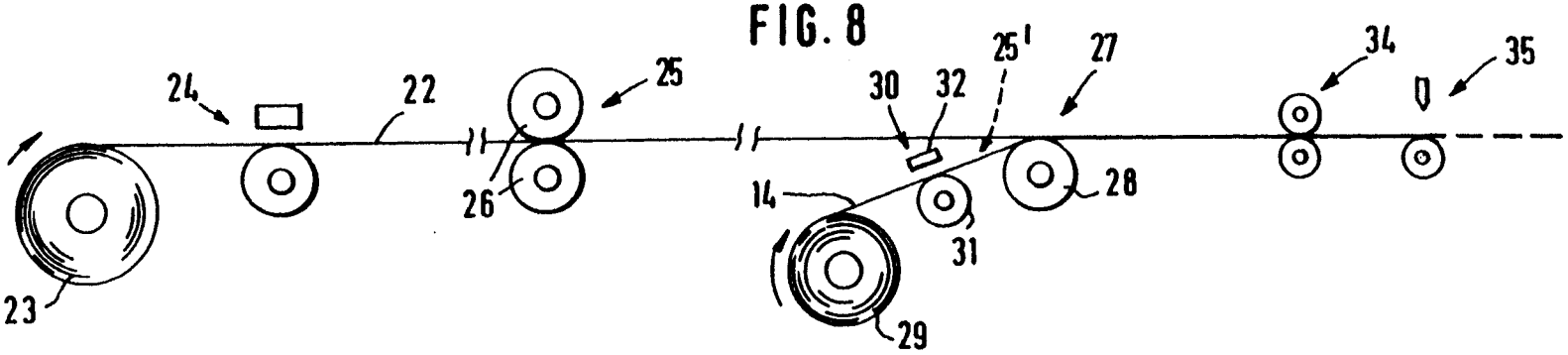
FIG. 8 diagrammatically shows the steps in a process for the manufacture of a strip baggage tag according to an embodiment of the invention.
Figure 9:
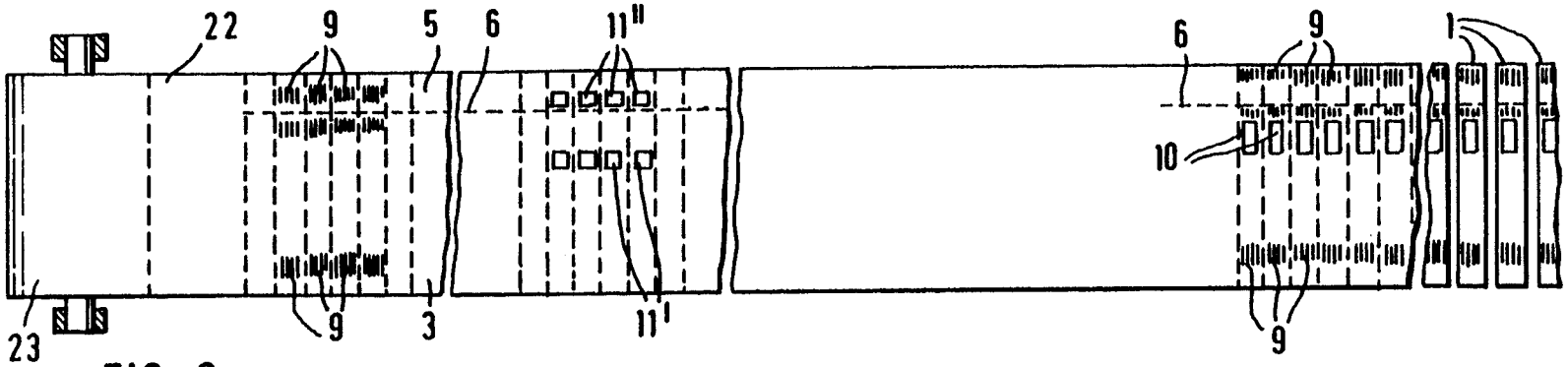
FIG. 9 is a partial top and bottom view of the web of material.
Figure 10:
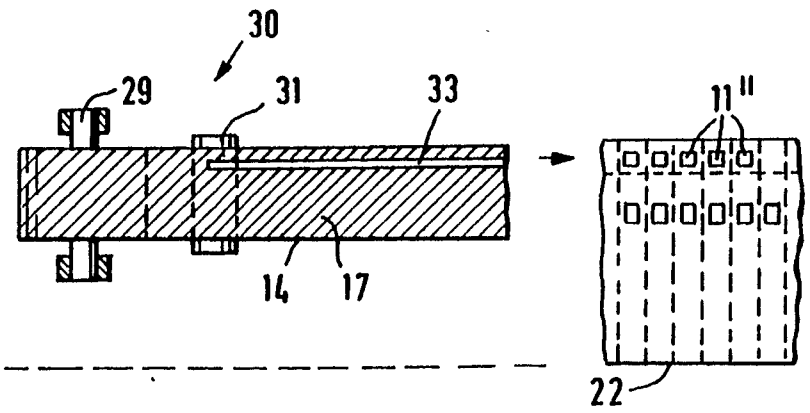
FIG. 10 shows the corona treatment of the separation-active coated web.

A process for the production of the above-described strip baggage tags, in accordance with an embodiment of the invention, can be explained with reference to FIGS. 8 to 10. The strip baggage tags are produced transversely to the direction of travel of a web of material 22, the width of which corresponds to the length of the strip baggage tag 1 according to FIG. 1. After withdrawal from a roll 23, the web of material 22 is, in a first operation, printed on its front side with the bar codes 9 at a printing station 24. At this stage, the separation line 6 can also be applied, making possible the subsequent detachment of the tear-off part 5 from the tag part 3.

Thereupon, in a second operation, pressure-sensitive adhesive is applied at an adhesive-applying station 25 onto the back of the web by means of a pair of rolls 26 so as to produce the adhesive areas 11' and 11''. This is indicated in FIG. 9 in a bottom view of the web of material 22.

At a joining station 27, the carbonless-copying lower web 14 which is coated with a separating agent so as to be separation-active is then fed to the web 22 within the region of a guide roller 28. The lower web 14 travels from a roller 29 through a station 30 where a corona treatment is performed. As shown in FIG. 10, the treatment station 30 comprises a lower electrode roll 31 and an upper electrode 32, between which the previously continuously applied separation-active coating 17 is made separation-inactive over a strip-shaped region 33, which will form the above-mentioned regions 18. The lower web 14 is then brought together with the web of material 22 via the roll 28 in such a manner that the separation-inactive region 33 of the lower web 14 comes to lie in the adhesive areas 11'', so that the lower web 14 can bond to the tear-off part 5 at the regions 18 of the strip baggage tags of FIGS. 1 and 4.

The web which have been brought together can then be printed within the writing boxes and the like in a printer 34 and then cut into the individual strip baggage tags 1 in a cutting station 35.

As an alternative, it is also possible to apply the adhesive 11 for the production of the adhesive areas 11' and 11'', not directly to the back of the web of material 22 as described above, but rather to the corresponding places on the lower web 14 which has already been corona-treated, in order then, by bringing the webs together, to transfer the adhesive in the transfer process to the back of the web of material 22. A corresponding adhesive application station 25' (see FIG. 8) would then be provided between the corona treatment station 30 and the joining station 27 where the web of material 22 and the lower web 14 are brought together.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A strip baggage tag having a tag part which is adapted for being written on, on a front side thereof, and applied to an article of luggage, and a control section;

the control section comprising a tear-off part which can be detached from the tag part along a transversely extending separation line;

adhesive areas arranged on a back side of the tag part and the tear-off part on both sides of the separation line;

the control section further comprising a single-piece lower web section which covers the adhesive areas and has means on its top side for copying of impressions made on said tag part;

said lower web section being substantially continuously coated with separating agent except for a partial region below the adhesive area of the tear-off part for adhering the lower web section to the tear-off part.

2. A strip baggage tag according to claim 1, wherein the partial region which is not coated with separating agent extends over substantially the entire width of the lower web section.

3. A strip baggage tag according to claim 1, wherein the adhesive areas are provided only on inner regions of the tag part and the control section, leaving narrow marginal zones along the longitudinal edges.

4. A strip baggage tag according to claim 1 wherein the lower web section extends to form a grip tab beyond the end of the tear-off part at the end of the strip baggage tag.

5. A strip baggage tag according to claim 4, wherein the lower web section is provided with a perforation, below the tear-off part, within the region of the lower web section which is coated with separating agent.

6. A strip baggage tag according to claim 5, wherein the perforation is arranged adjacent to the region of the lower web section which is not coated with separating agent.

7. A strip baggage tag according to claim 1, wherein the means on the top side of the single-piece lower web section for copying of impressions made on said tag part, provides carbonless copying of such impressions.

* * * * *